US006390522B1

(12) United States Patent
Rucker

(10) Patent No.: US 6,390,522 B1
(45) Date of Patent: May 21, 2002

(54) COMBINATION LID LOCK AND COMPACTOR

(76) Inventor: Allen E. Rucker, 8804 Dangerfield Ct., Clinton, MD (US) 20735

( * ) Notice: Subject to any disclaimer, the term of this patent is extended or adjusted under 35 U.S.C. 154(b) by 0 days.

(21) Appl. No.: 09/686,082

(22) Filed: Oct. 12, 2000

Related U.S. Application Data

(60) Provisional application No. 60/163,262, filed on Nov. 3, 1999.

(51) Int. Cl.[7] ..... B65D 45/28; B65D 55/16

(52) U.S. Cl. ..... 294/15; 294/24; 220/315; 220/318; 220/908

(58) Field of Search ..... 294/15, 24, 26, 294/27.1, 137, 165; 220/243, 314, 315, 318, 908

(56) References Cited

U.S. PATENT DOCUMENTS

| | | | | | |
|---|---|---|---|---|---|
| 20,203 | A | | 5/1858 | Gilmore | 292/259 R |
| 33,729 | A | * | 11/1861 | Fisher | 220/315 |
| 39,853 | A | | 9/1863 | Webster | 292/259 R |
| 181,269 | A | | 8/1876 | Keese et al. | 220/314 |
| 215,674 | A | | 5/1879 | Record | 220/23.87 |
| 218,411 | A | | 8/1879 | Wassmer et al. | 220/314 |
| 1,627,302 | A | | 5/1927 | Wright | 220/314 |
| 1,666,012 | A | * | 4/1928 | Humphrey | 220/318 |
| 2,325,808 | A | | 8/1943 | Stephansko | 220/251 |
| 2,661,974 | A | | 12/1953 | Zehnder | 2220/314 |
| 2,936,095 | A | * | 5/1960 | Mereness | 220/318 |
| 3,140,795 | A | | 7/1964 | Griffithe et al. | 2220/318 |
| 3,244,316 | A | * | 4/1966 | Atkinson et al. | 220/318 |
| 3,273,747 | A | * | 9/1966 | Kalz | 220/318 |
| 3,312,373 | A | | 4/1967 | Gentry | 220/314 |
| 3,525,429 | A | * | 8/1970 | Vaughn | 220/318 |
| 3,817,563 | A | | 6/1974 | McGlothlin | 220/318 |
| 3,935,964 | A | * | 2/1976 | Saxe | 220/318 |
| 4,095,830 | A | | 6/1978 | Spellman | 292/288 |
| 4,185,752 | A | | 1/1980 | Basile | 220/314 |
| 4,384,656 | A | * | 5/1983 | Mcquiston et al. | 220/318 |
| 4,413,851 | A | | 11/1983 | Ritter | 292/259 R |
| 4,545,501 | A | * | 10/1985 | DeFord | 220/318 |
| 4,609,200 | A | * | 9/1986 | Winter | 294/165 |
| 4,644,874 | A | | 2/1987 | Kleykamp | 227/314 |
| 4,691,840 | A | * | 9/1987 | Ferbrache | 220/318 |
| 4,784,286 | A | * | 11/1988 | Dahrendorf et al. | 220/315 |
| 4,807,916 | A | * | 2/1989 | Erickson | 294/15 |
| 4,819,827 | A | * | 4/1989 | DiSesa | 220/318 |
| 4,915,253 | A | | 4/1990 | Sharp | 220/314 |

(List continued on next page.)

FOREIGN PATENT DOCUMENTS

| | | | | |
|---|---|---|---|---|
| AU | 250433 | * | 3/1964 | 220/318 |
| DE | 301471 | * | 11/1917 | 220/318 |
| DE | 410020 | * | 2/1925 | 220/314 |
| DE | 927352 | * | 5/1955 | 220/315 |
| DK | 72190 | | 2/1951 | |
| FR | 658075 | | 5/1929 | |
| FR | 1142648 | * | 4/1957 | 220/314 |
| GB | 153965 | * | 11/1920 | 220/314 |
| GB | 347405 | | 5/1931 | |
| GB | 392 074 | | 5/1933 | |
| GB | 857839 | * | 1/1961 | 294/15 |

*Primary Examiner*—Eileen D. Lillis
*Assistant Examiner*—Paul T. Chin
(74) *Attorney, Agent, or Firm*—Richard C. Litman

(57) ABSTRACT

A combination lid lock, lever and compactor device has a tubular structure bent into a shape resembling a lazy letter W or curvilinear structure with lobes. Welded to the bottom of one of the lobes is a small rectangular stabilizing plate. A non-skid end guard is located on one end, and a non-slip handle is located on the other end. The rectangular plate is located on a first lobe, and the second and third lobes provide more than three points of stable contact with the lid and handles of the refuse receptacle. The skid resistant capped end of the device can also be used to force refuse deeper into the receptacle. The device can be used as a lever serving as an auxiliary handle on a receptacle with wheels and a side handle on the side nearest the wheels.

8 Claims, 5 Drawing Sheets

U.S. PATENT DOCUMENTS 5,078,295 A * 1/1992 Grant ..... 220/318
5,297,692 A * 3/1994 Kronmiller ..... 220/318
5,638,977 A 6/1997 Bianchi ..... 227/314
5,842,594 A 12/1998 Ibara ..... 220/314
6,041,960 A * 3/2000 Leal ..... 220/318

* cited by examiner

COMBINATION LID LOCK AND COMPACTOR

CROSS-REFERENCE TO RELATED APPLICATION

This application claims the benefit of U.S. Provisional Patent Application Serial No. 60/163,262, filed Nov. 3, 1999.

BACKGROUND OF THE INVENTION

1. Field of The Invention

The present invention relates generally to the integrity of refuse retention devices. More specifically, the invention is a device designed to keep a lid installed on a waste receptacle even when it is being jostled about. The device can be used to compact trash in a container and used as a lever to move certain trash barrels with wheels.

2. Description of Related Art

Numerous devices have been developed that are designed to immobilize in place the lid or cover of a container. Despite similarities with the device under consideration, the apparatus and methods used by conventional techniques are not suitable to be applied to the case of the current invention as herein described. In other words, conventional lid retention devices. superficially resemble and do not compare in structure or function to a device which provides a combination of lid removal, trash can mobility and trash can compaction as herein described.

For example, U.S. Pat. No. 2,325,808 issued to Stephansko discloses a galvanized steel garbage can with a lid containing pivotable rods that lock the lid on the can. Rotating a central handle causes the lid to lock or unlock. However, there might be problems associated with adopting this design with plastic materials.

The nature of the refuse receptacle has changed: years ago they were made of galvanized steel, but now plastics are increasingly used in their construction. They also now come with multi-functional handles and wheels.

For example, U.S. Pat. No. 2,325,808 issued to Stephansko discloses a galvanized steel garbage can with a lid containing pivotable rods that lock the lid on the can. Rotating a central handle causes the lid to lock or unlock. However, there might be problems associated with adopting this design with plastic materials.

Over the years, refuse collection has changed to reflect higher productivity standards. Refuse collectors are going to balk at removing trash from cans that require the performance of a sequence of steps or a great deal of effort in order to open the refuse can.

U.S. Pat. No. 2,661,974 issued to Zehnder discloses a lid held on a can by a rod thrust through a hand grip on the top of the lid. Each end of the rod is held in place by springs tethered to opposing handle grips on the sides of the can. The result is a lid held firmly in place. Having to undo such spring loaded devices can be time consuming under such rushed circumstances as encountered by refuse collectors.

Similarly, U.S. Pat. No. 3,140,795 issued to Griffith et al discloses the use of coiled springs. The coiled springs constitute a waste band around the can and a connection through a handle on the top of the lid from one side of the waste band to its opposite side. The remarks made concerning the previous paragraph also seem to apply here. There is also the possibility that springs can catch a child's finger or hair or an animal's fir.

A U.S. Pat. No. 3,817,563 issued to McGlothlin is similar to U.S. Pat. Nos. 2,325,808 and 3,140,795. It is subject to the same criticisms.

A number of patents have been issued for retaining straps with loops. U.S. Pat. No. 4,095,830 issued to Spellman discloses a resilient one-piece tension strap having three strap extension portions terminating in three looped portions for attachment. The opposing loops are meant to attach to a can's side handles while the other loop attaches to a hook anchored to a stationary object. This device features no rigid bars or any rigid members at all.

U.S. Pat. No. 4,413,851 issued to Ritter discloses a broad retainer strap used to hold in a closed position a lid on a can with opposed open-loop side handles. One end encompasses one side handle and doubles back on itself in a buckle. The other end goes around the other side handle and is attached to itself with a pair of detachable snap fasteners. The same remarks made regarding U.S. Pat. No. 4,095,830 can be applied to this patent.

U.S. Pat. No. 4,644,874 issued to Kleykamp discloses a hatch cover used mostly for hopper cars. The lid is made of a polymeric material. It should be clear that the disadvantage of this device is its costly nature. The same could be said of the device of U.S. Pat. No. 4,915,253 issued to Sharp. This discloses a removable center-point compression sealing Lid.

U.S. Pat. No. 5,638,977 issued to Bianchi discloses a lid secured by means of a system of holes placed in the lid rim in alignment with the corresponding holes in the top rim of the container. A securing rod passes through the corresponding holes. A conduit is provided on the underside of the lid in alignment with the holes in the lid and the holes in the container.

A French Patent FR 658,075 issued to Migaud discloses a can such that the lid has a bar welded along a diameter and each end of the bar is curved to produce a semicircle so as to create two opposite hooks. In correspondence with these hooks are loops mounted on the sides of the can. One of these loops is moved by means of a thumb lever a variable distance with respect to its corresponding hook such that the maximum resistance of the hook to the loop occurs just before the thumb lever is snapped shut.

A Patent of Great Britain GB 347,405 issued to Robinson discloses a lid to a can so that the lid is provided with a transverse handle whose ends are extended past the edge of the lid and can, and are adapted to be bent so as to secure the lid to the rim of the can.

None of the above inventions and patents, taken either singly or in combination, is seen to describe the instant invention as claimed.

SUMMARY OF THE INVENTION

The combination lid lock and compactor according to the present invention has a tubular structure which conformed to a shape somewhat resembling a lazy letter W or curvilinear structure. Welded perpendicularly to the bottom at one of the lobes of the "W" is a small rectangular plate or stabilizer which reduces turning forces or torques. A non-skid end guard is put on the far end and a non-slip handle grip is located on the other end for user manipulation. The rectangular plate on the first lobe and the second lobe of the "W" provide more than three points of stable contact with a lid of a refuse receptacle. The parts of the lid lock that resemble the "wings" of the "W" having minima and maxima surface contours which provide a point of contact within an opposing hand grip apertures which are conventionally mounted on the sides of a receptacle. The skid resistant capped end of the lid lock can also be used to force refuse deeper into the receptacle as a manually operated trash compactor. In another state, the lid lock is used as a lever serving as an auxiliary handle on a receptacle with wheels and a side handle on the side nearest the wheels for easy manipulation and rolling transport by a user.

Accordingly, it is a principal object of the invention to secure a lid on a refuse can by means of a simple device designed to fit under oppositely situated handles near the rim of a refuse can and exert pressure on the lid of the can so as to secure or lock it.

It is another object of the invention to provide a combination lid lock and compactor as a wedged member under a receptacle's front hand grip adjacent to a receptacle side having wheels at its base so that the rubber on the far end grips the body of the receptacle and the handle of the invention can be used to control the receptacle in a transport mode.

It is a further object of the invention to provide a combination lid lock and compactor which serve as a single device trash compactor by inserting the far or first end (opposite the near or second end) into the receptacle to fend off the miscreant garbage.

Still another object of the invention is to provide a combination lid lock and compactor which also serves as a lever.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
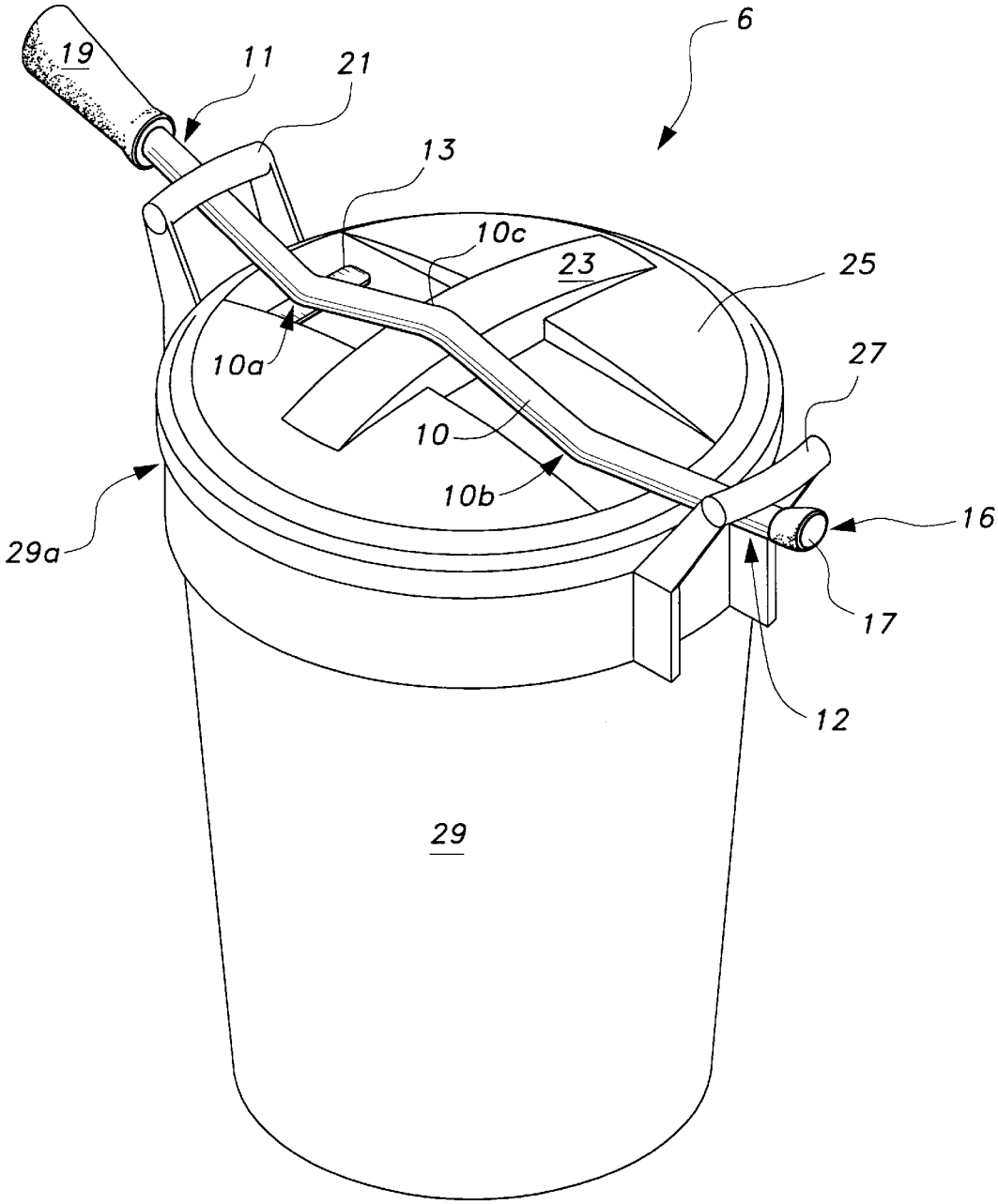
FIG. 1 is an environmental, perspective view of a combination lid lock and compactor according to the present invention.

The present invention is directed to a combination lid lock and compactor for a refuse container or similar receptacle. The preferred embodiment of the present invention is depicted in FIGS. 1–4, with a variation of elemental features of the invention depicted in FIGS. 5A–5C. The preferred embodiment is generally referenced by numeral 6.

As illustrated in FIGS. 1–4, the combined lid lock and compactor according to the preferred embodiment 6 comprises a tubular body 10 of length almost two orders of magnitude greater than its cylindrical radius. The tubular body 10 has a contour such that the entire length of the device lies entirely in one plane with the exception of a rectangular or planar stabilizer 13 welded to the tube 10 for retaining a lid 23 on a trash receptacle or can 29 in a locked position or state. The tubular body 10 is bent having a fit parallel to and in contour with the lid 25 so as to avoid kinks or creases therein. As seen from an edge view in FIG. 1, the curved tube 10 traces a "cylindrical" line segment as projected in two-dimensional (2D) space having a definite polynomial mathematical pattern. Accordingly, the curve representative of the tube 10 by this pattern, preferably has two minima located along the length of the tube 10 defined by points 10*a* and 10*b*. The space defined between these points 10*a* and 10*b* include a maxima located therebetween defined by point 10*c*. The more linear portions of the tube 10 are near the extreme ends 11 and 12. All points of which when connected defines a curvilinear pattern or contour representative of the tube 10. It is this mapping technique which is used to produce a specific lid lock compactor 10 for a given trash receptacle 29 and lid 25 assembly.

In FIG. 1, an exemplary illustration is shown depicting the device 6 as resembling a polynomial curved structure. The two minima 10*a* and 10*b* of the curve correspond to points where the lid lock element 10 makes contact with the lid 25 of the receptacle 29. The rectangular shaped stabilizer 13 is welded perpendicularly to a bottom surface portion of the tube 10 proximate to at least one minima 10*a*, 10*b*. The attachment of the stabilizer 13 with the tube 10 is made such that a free surface portion of the stabilizer is made flush with a top surface portion of the lid 25. The weld which permanently secures the stabilizer 13 to the tube 10 is made such that a middle portion of the of the rectangular piece 13 to prevent extraneous torques which may cause the lid lock 6 to twist out of a locking position during contact with the receptacle 29. The portion in the tubular body 10, corresponding to the maxima 10*c* in the curve between minima 10*a*, 10*b* avoids a handle portion 23 typical of a conventional lid 25.

The tubular body 10 makes contact with the receptacle 29 via handles 21 and 27, respectively near handle end 19 the far end 16 defined with a non-skid end cap 17. The handles 21 and 27 exert a force on the tubular body 10 and the tubular body exerts an equal but opposite force on the handles 21 and 27. The lid lock or tube 10 is preferably made as a rigid static body 10 which operatively exerts a force on the lid 25 and wherein the lid 25 exerts an equal and opposite reactionary force on the tubular body 10 without lid 25 distortion or deformation. As such, the lid 25 exerts a force on a top surface or rim portion 29*a* of the receptacle 29 whereby the surface portion exerts an equal but opposite reactionary force on the lid 25. Because the receptacle 29 is made of a static and semi-rigid material, handles 21 and 27 are inherently configured to exert and withstand an effective force on and from the tubular body 10.

Figure 2:
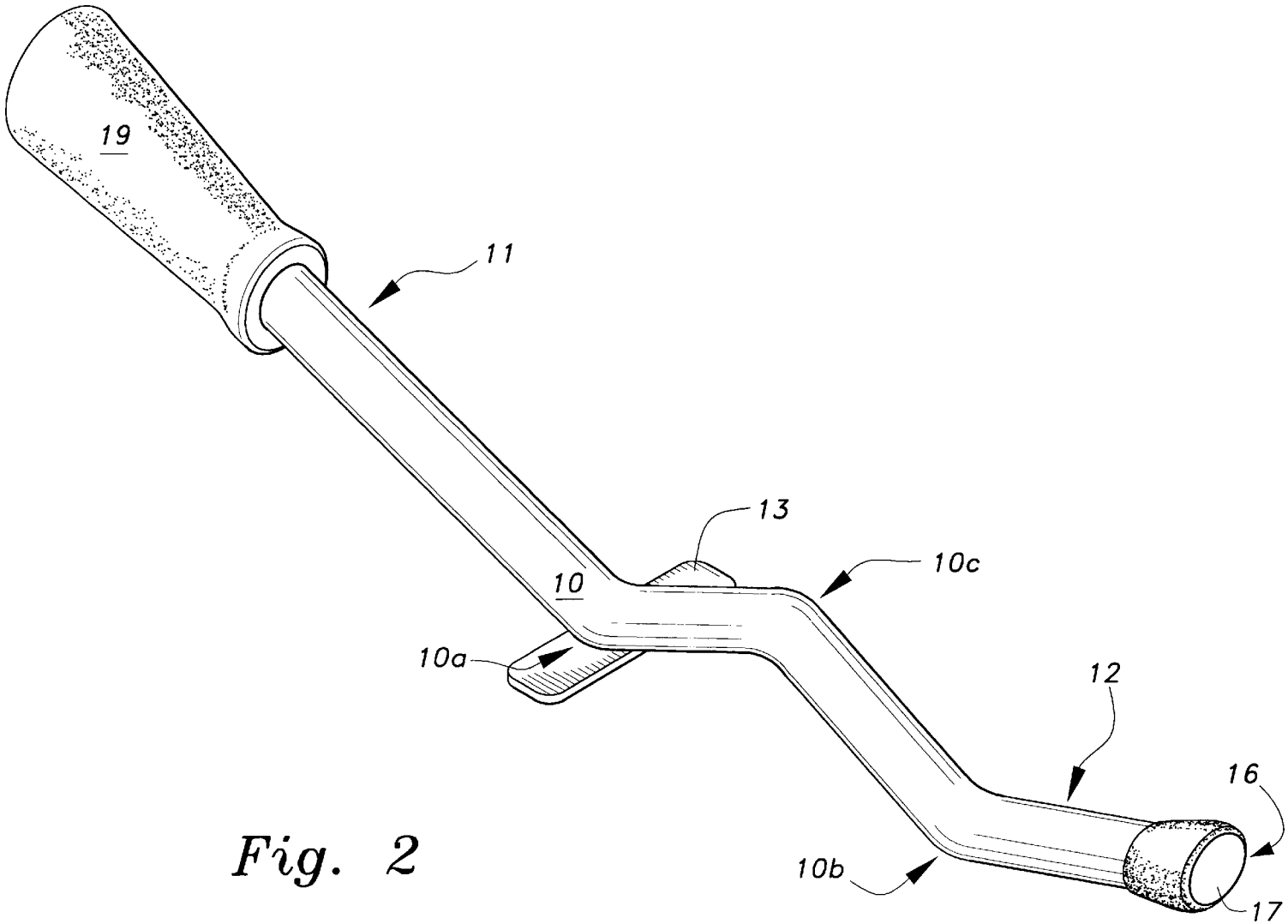
FIG. 2 is a perspective view of the combination lid lock and compactor according to the present invention.

As illustrated in FIG. 2 in more detail, the combination lid lock and compactor 6 is shown in perspective or isolated view. As shown therein, the rectangular piece 13 is seen to be welded perpendicular to the tubular body 10 near the point corresponding to the minima, nearest the handle 19. The end 16 opposite the handle end 19 is shown capped with a non-skid shaft end protector 17. This particular cap can be made of any number of materials such as, metallic material, rubber, plastic or a combination thereof.

Figure 3:
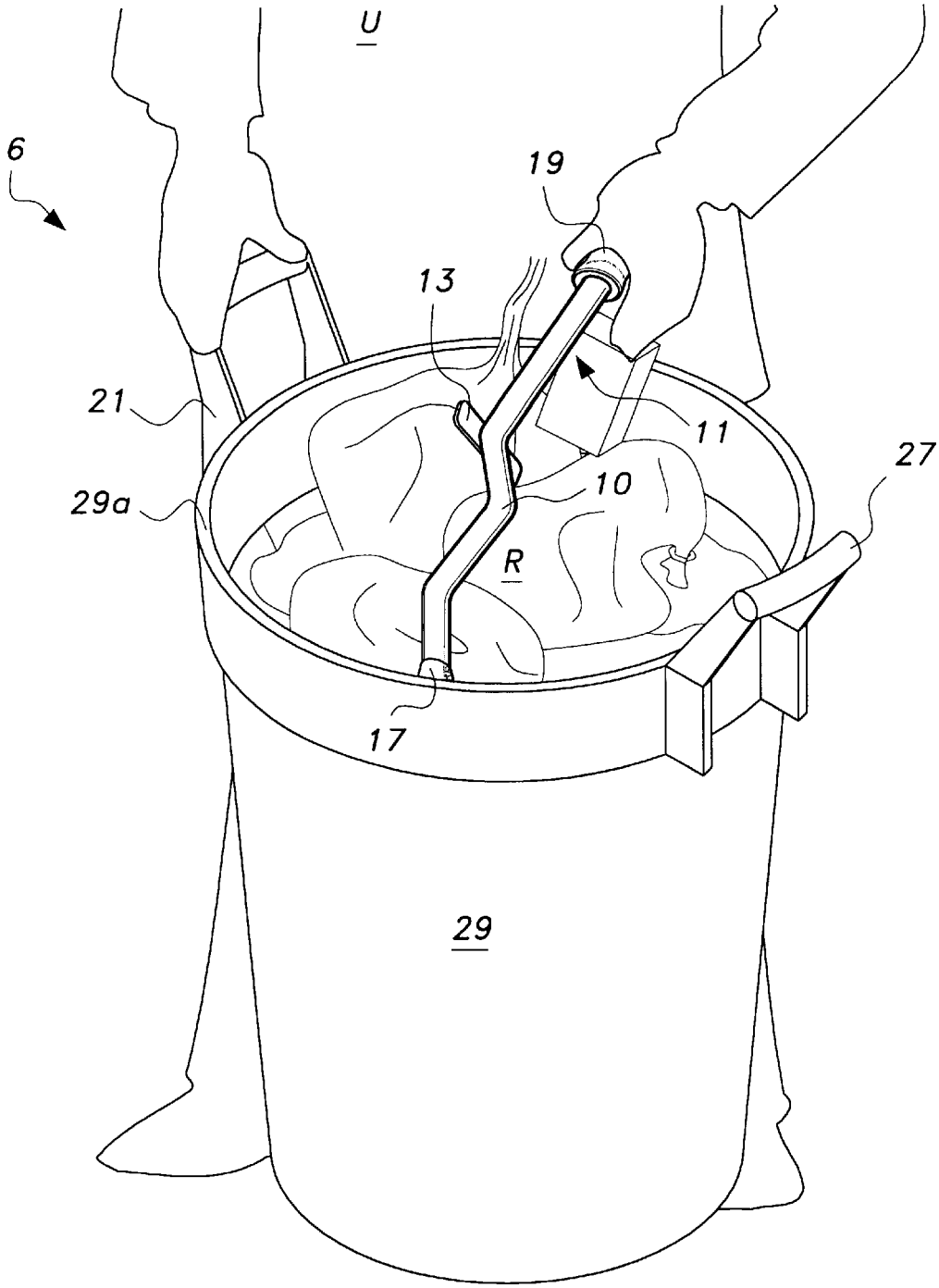
FIG. 3 is an environmental perspective view of the combination lid lock and compactor employed as a compactor according to the invention.
Figure 4:
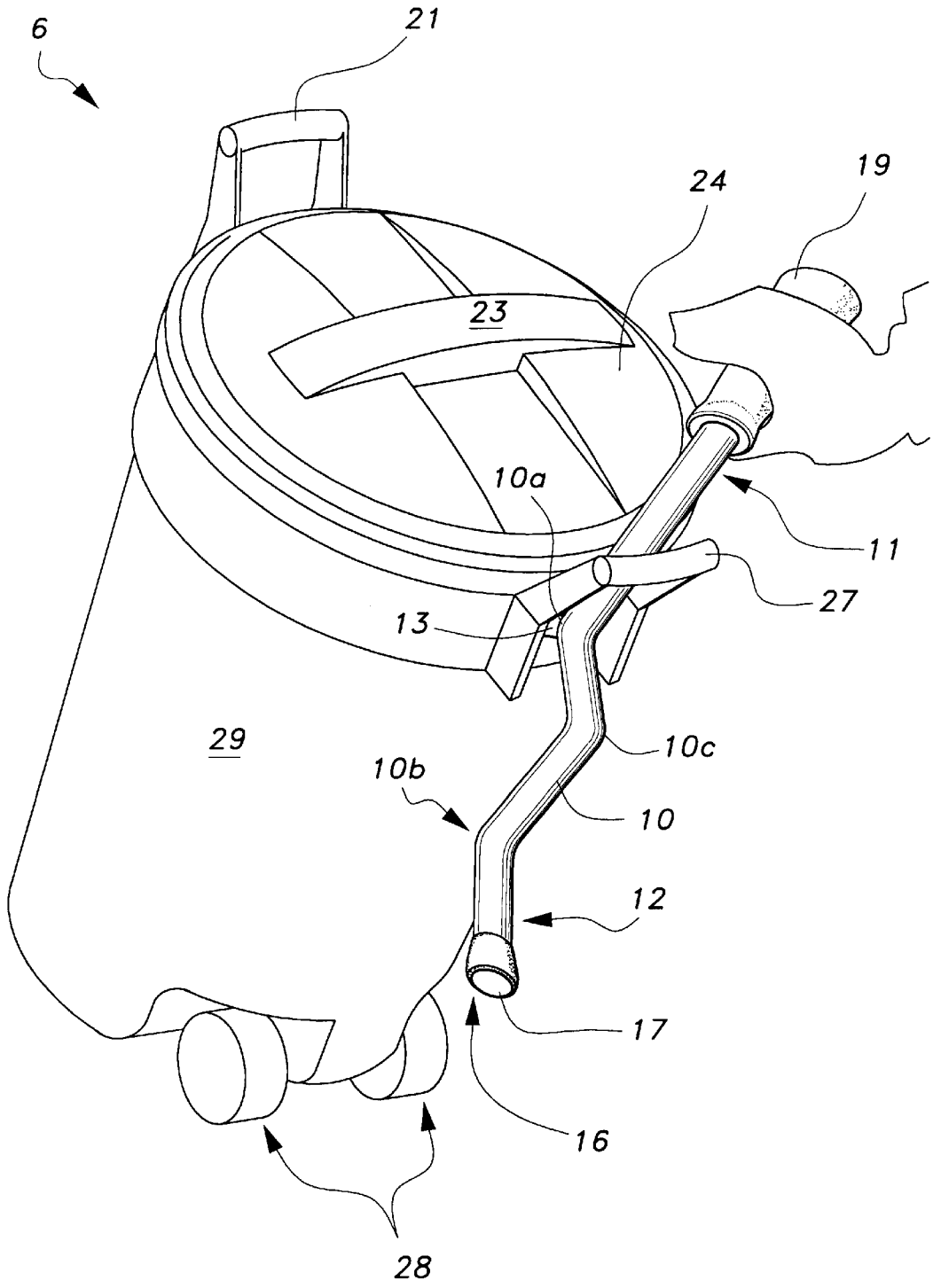
FIG. 4 is a perspective view of the combination lid lock and compactor in combination with and moving a mobile trash can according to the invention.

As illustrated in FIG. 3, the combination lid lock and compactor 6 is shown wherein a user U is utilizing the tubular lid lock element 10 as a trash compactor. As often needed the compactor use of the tubular body 10 serves to provide a perpendicular contact force via the non-skid capped end 17, with refuse R in order to reduce refuse R volume within the receptacle 29. Accordingly, the tube 10 can be used as a lever to manipulate and transport an otherwise heavy or contaminate trash receptacle 29 having wheels 28 as illustrated in FIG. 4. This particular feature significantly, reduces the degree of physical exertion by the user U and the potential of related injuries thereto.

As diagrammatically illustrated in FIG. 4, the tubular body 10 is put through the handle 27 on a side closest to the wheels 28. The maxima and minima points on the tubular body 10 that make contact with the lid handle 23 as illustrated in FIG. 1 now make secure, releasable contact with a side portion of the receptacle 29 for subsequent receptacle 29 manipulation and transport by the user U.

Figure 5A:
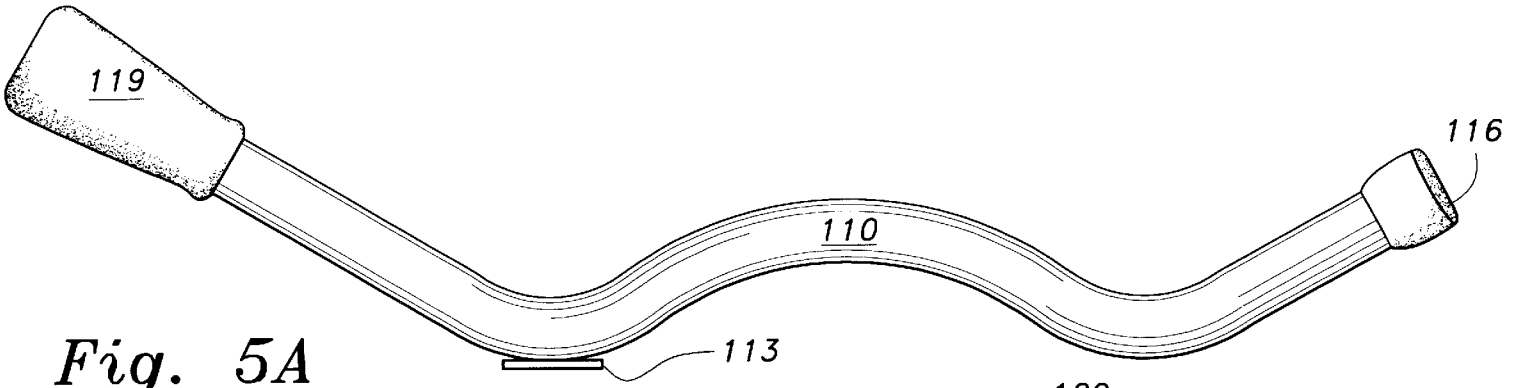
FIG. 5A is a perspective side view of a lid lock compactor according to a first contour of the invention.
Figure 5B:
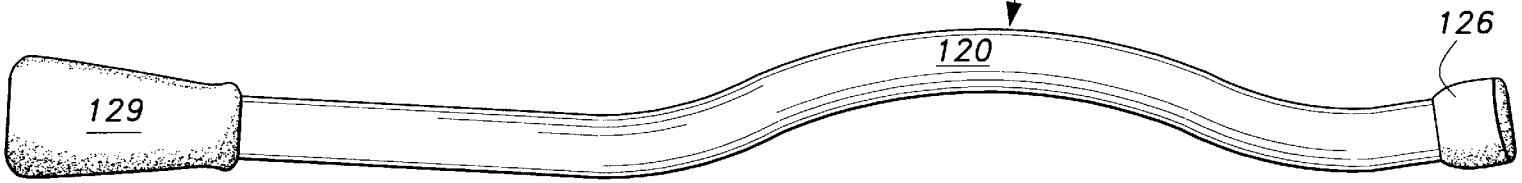
FIG. 5B is a perspective side view of a lid lock compactor according to a second contour of the invention.
Figure 5C:
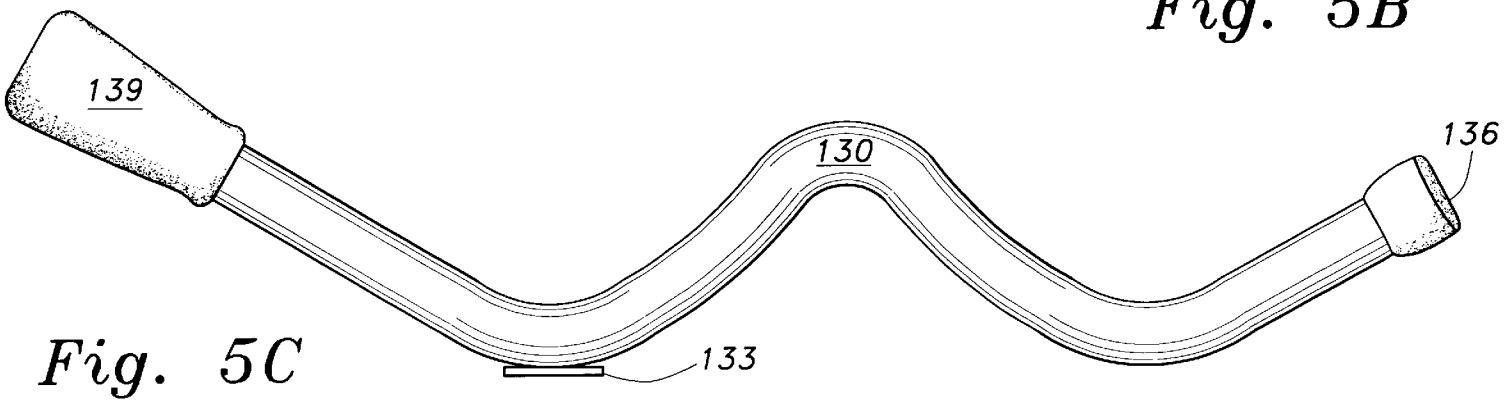
FIG. 5C is a perspective side view of a lid lock compactor according to a third contour of the invention.

As diagrammatically illustrated in FIGS. 5A–C, the combination lid lock and compactor is presented having structural curvatures of different slopes in maxima and minima as alternative contours for different lid 25 configurations. In FIG. 5A, the tubular body 110 has a more gradual curve and the point of contact with a lid 25 at the shaft stabilizer plate 113 and the point of contact near the far end with the non-skid end cap 116 are spaced further apart. (The second mentioned point is the point corresponding to the minima closest to the far end as described in the first paragraph of this section). A handle grip 119 is shown in a usual arrangement.

In FIG. 5B, the point of contact corresponding to the minima nearest the non-skid end cap 126 is shown substantially as the end cap 126 itself. The tubular body 120 has less curvature or variation in curvature and thereby becomes more stable to manipulate by a user U. Thus, as illustrated in other embodiments this configuration does not require the use of a stabilizer plate 113. In other words, the spot on the tubular body 120 corresponding to a maxima 120*a* is more prone to be in contact with a lid handle for easy manipulation and control which makes the need for a stabilizer plate unnecessary. A handle grip 129 is shown in usual arrangement as previously described. However, this contour may be most suitable for the embodiment depicting an auxiliary handle or lever as described in FIG. 4, because of the reduced curvature which allows for easy insertion and a longer lever arm for producing moment forces for receptacle 29 inclination and subsequent wheel transportation.

In FIG. 5C, the tubular body 130 has a shape corresponding to maxima and minima which are more pronounced than with the other embodiments. This embodiment is designed to be used with a narrow can 29 or a lid 25 having a high central handle lid portion. A shaft stabilizer 133 is used. A handle grip 139 and a non-skid end cap 136 are also used in normal arrangement.

It is to be understood that the present invention is not limited to the sole embodiments described above, but encompasses any and all embodiments within the scope of the following claims.

I claim:

1. A combination lid lock and compactor system for a trash can lid and receptacle assembly consisting essentially of:

i) a tubular body having a first and a second end portion, said tubular body having two minimum lobes and a maximum lobe such that each of the minimum and maximum lobes provides surface portions for coincident and abutting attachment with a common surface portion of the lid of said assembly;

ii) a means for stabilizing the tubular portion for reducing an externally applied torque, said means being configured and dimensioned for peripheral attachment with the tubular body proximate the first end portion of said tubular body, and wherein said means comprises a free end for abutment with a surface portion of said lid; and iii) wherein in the tubular body, said lobes change in a lengthwise direction of the tubular body, and have a radius of curvature which alternates from positive to negative and from negative to positive at least once to form said lobes.

2. The combination lid lock and compactor system according to claim 1, including:

i) a non-slip handle grip to cover said first end portion and;

ii) a non-skid cap to cover said second end portion.

3. The combination lid lock and compactor system according to claim 2, wherein said stabilizer means is a substantially rectangular plate of predetermined thickness, and said plate is fixedly attached to the tubular body via welding.

4. A combination lid lock and compactor device comprising in combination with a trash can lid and container having top handles peripherally disposed thereon, and consisting essentially of;

i) a tubular body having a first and a second end portion, said tubular body having two minimum lobes and one maximum lobe such that each lobe provides a surface portion for coincident and abutting attachment with a common surface portion of the trash can lid;

ii) a means for stabilizing the tubular body for reducing an externally applied torque, said means being configured and dimensioned for peripheral attachment proximate the first end portion of said tubular body, and wherein said means comprises a free end for abutment with a surface portion of said trash can lid; and iii) wherein in the tubular body, said lobes change in a lengthwise direction of the tubular body, and have a radius of curvature which alternates from positive to negative and from negative to positive at least once to form said lobes.

5. The combination lid lock and compactor device according to claim 4, including:

i) a non-skid cap to cover said first end portion; and ii) a non-slip handle grip to cover said second end portion.

6. The combination lid lock and compactor device according to claim 4, wherein said stabilizer means is a substantially rectangular plate of predetermined thickness, and said plate is fixedly attached to the tubular body via welding.

7. The combination lid lock and compactor device according to claim 6, wherein said plate is a thin wafer-like metallic structure having a specified structural rigidity resistant to cyclical fatigue and structural deformation.

8. The combination lid lock and compactor device according to claim 7, wherein said plate is impervious to rust and corrosion.

* * * * *